US005754037A

United States Patent [19]

Ezell et al.

[11] Patent Number: 5,754,037

[45] Date of Patent: May 19, 1998

[54] DIGITALLY ADAPTIVE BIASING REGULATOR

[75] Inventors: William Richard Ezell, Carrollton; Robert Mounger, Dallas, both of Tex.

[73] Assignee: Dallas Semiconductor Corporation, Dallas, Tex.

[21] Appl. No.: 688,479

[22] Filed: Jul. 30, 1996

[51] Int. Cl.[6] ..... G05F 1/56

[52] U.S. Cl. ..... 323/273

[58] Field of Search ..... 323/265, 266, 323/270, 271, 273, 303

[56] References Cited

U.S. PATENT DOCUMENTS 5,124,632 6/1992 Greaves ..... 323/316
5,241,261 8/1993 Edwards et al. ..... 323/313
5,488,284 1/1996 Dias et al. ..... 320/39
5,514,945 5/1996 Jones ..... 320/14
5,570,004 10/1996 Shibata ..... 323/303
5,596,264 1/1997 Bichler et al. ..... 323/284

*Primary Examiner*—Matthew V. Nguyen
*Attorney, Agent, or Firm*—Jenkens & Gilchrist

[57] ABSTRACT

The present invention regulates a power signal provided by a power source and includes two operational modes: a first mode capable of consuming low amounts of static power; and a second mode capable of smoothing voltage spikes appearing at high frequencies. The present invention further includes a generator, amplifier, and a regulator for controlling the power signal; a device for determining whether the present invention should be in the first or second operational mode; and a device for shifting between the first and second operational modes.

21 Claims, 6 Drawing Sheets

DIGITALLY ADAPTIVE BIASING REGULATOR

FIELD OF THE INVENTION

The present invention relates to on-chip power suppliers and, in particular, to one-wire circuit voltage regulators and high frequency voltage spike filters.

CROSS REFERENCE TO RELATED APPLICATIONS

This application is related to the following U.S. Patent Applications:

| APPLICATION SERIAL NO. | TITLE | INVENTOR(S) |
|---|---|---|
| 08/688,589 | Auto Zero Circuitry and Associated Method | Richard William Ezell<br>Robert Mounger |
| 08/688444 | Battery Pack Monitoring System | Richard E. Downs<br>Robert Mounger |

All of the related applications are filed on even date herewith, are assigned to the assignee of the present invention, and are hereby incorporated herein in their entirety by this reference thereto.

BACKGROUND OF THE INVENTION

With the continued development of battery packs used in electronic devices such as cellular phones and notebook computers, a need has arisen for circuitry to regulate voltages between the battery packs and the electronic devices, as well as to provide interfaces.

In order to meet the ever increasing demand for longer battery life in these battery packs, the devices using these battery packs need to be optimized to consume as little power as possible. Therefore, a low voltage operating circuit is often linked to a higher voltage source, thereby requiring a voltage regulator unless the electronic circuit is redesigned to operate at the higher voltages. Redesigning the circuit has numerous disadvantages, including increased expense and a less desirable circuit.

In one-wire technology, wherein data and power are transmitted over the same single wire, it is desirable to have a voltage regulator not only to provide a stable voltage source, but also to have an output power capability able to smooth voltage spikes occurring at high frequencies. In one-wire technology, if the output power capability of the regulator is not sufficient, the one-wire circuit will fail.

To produce an output power capability able to smooth these voltage spikes, existing voltage regulators require a high static power consumption. Unfortunately, with today's battery manufactures, this high static power consumption is unacceptable.

While the power output capability of the regulator contained in the one-wire circuit must be sufficiently large as to handle voltage spikes, the static power consumption of the regulator must be low. Regulators capable of consuming low amounts of static power exist. They, however, are plagued by an output impedance problem across frequency. Accordingly, no available voltage regulator both consumes low amounts of static power and smooths high frequency voltage spikes.

SUMMARY OF THE INVENTION

The present invention overcomes the above identified problems as well as other shortcomings and deficiencies of existing technologies by providing a voltage regulator and high frequency voltage spike filter for low power electronic devices. In particular, the present invention provides a digitally adaptive biasing regulator (DABR) capable of both smoothing voltage spikes occurring at high frequencies and operating with low static power consumption. The present invention succeeds in filling a gap in voltage regulator technology by shifting between a sufficient output power mode and a low static power consumption mode.

The DABR is biased towards the low static power consumption mode. The DABR only shifts from the low static power consumption standby mode to an active mode when an appropriate signal is received at an input line indicating activity. The DABR performs this process through adaptive biasing which senses activity and then changes the amount of energy that the circuit consumes internally. When the DABR is shifted to the higher power consumption active mode, it is capable of handling the voltage spikes occurring at high frequencies. The operation of the circuit begins with the detection of a changing input signal by a control circuit. The control circuit then shifts the power amplifier, which provides the output for the invention, into an active mode. The amplifier is permitted to remain in active mode for a predetermined amount of time. At the expiration of that predetermined amount of time, a check is made to determine whether certain activity in a device is taking place. If no activity is taking place, the amplifier is placed in standby mode. Otherwise, the amplifier remains active.

By being able to shift between the low static power consumption standby mode and the active mode capable of handling voltage spikes occurring at high frequencies, the DABR has filled the gap in current technology.

BRIEF DESCRIPTION OF THE DRAWINGS

A more complete understanding of the present invention may be had by reference to the following detailed description and appended claims when taken in conjunction with the accompanying drawings wherein:

DETAILED DESCRIPTION

Figure 1:
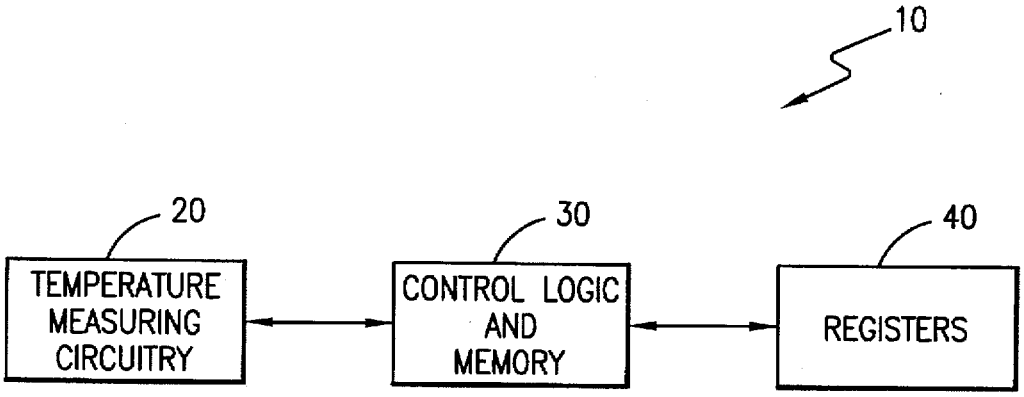
FIG. 1 is a functional block diagram of a thermometer system utilizing the present invention.

Referring now to FIG. 1, there is illustrated a block diagram of a thermometer system 10 in which the present invention is utilized. As depicted, thermometer system 10 includes temperature measuring circuitry 20, control and logic circuitry 30, and registers 40. Good results have been achieved by including the present invention in the temperature measuring circuitry 20.

The temperature measuring circuitry 20 is connected to the control logic and memory 30. The control logic and memory 30 instructs the temperature measuring circuitry 20 when to measure temperature. The control logic memory 30 receives the measured temperature from the temperature measuring circuitry 20, and then processes and transmits the data to the registers 40 for storage and use.

Figure 2:
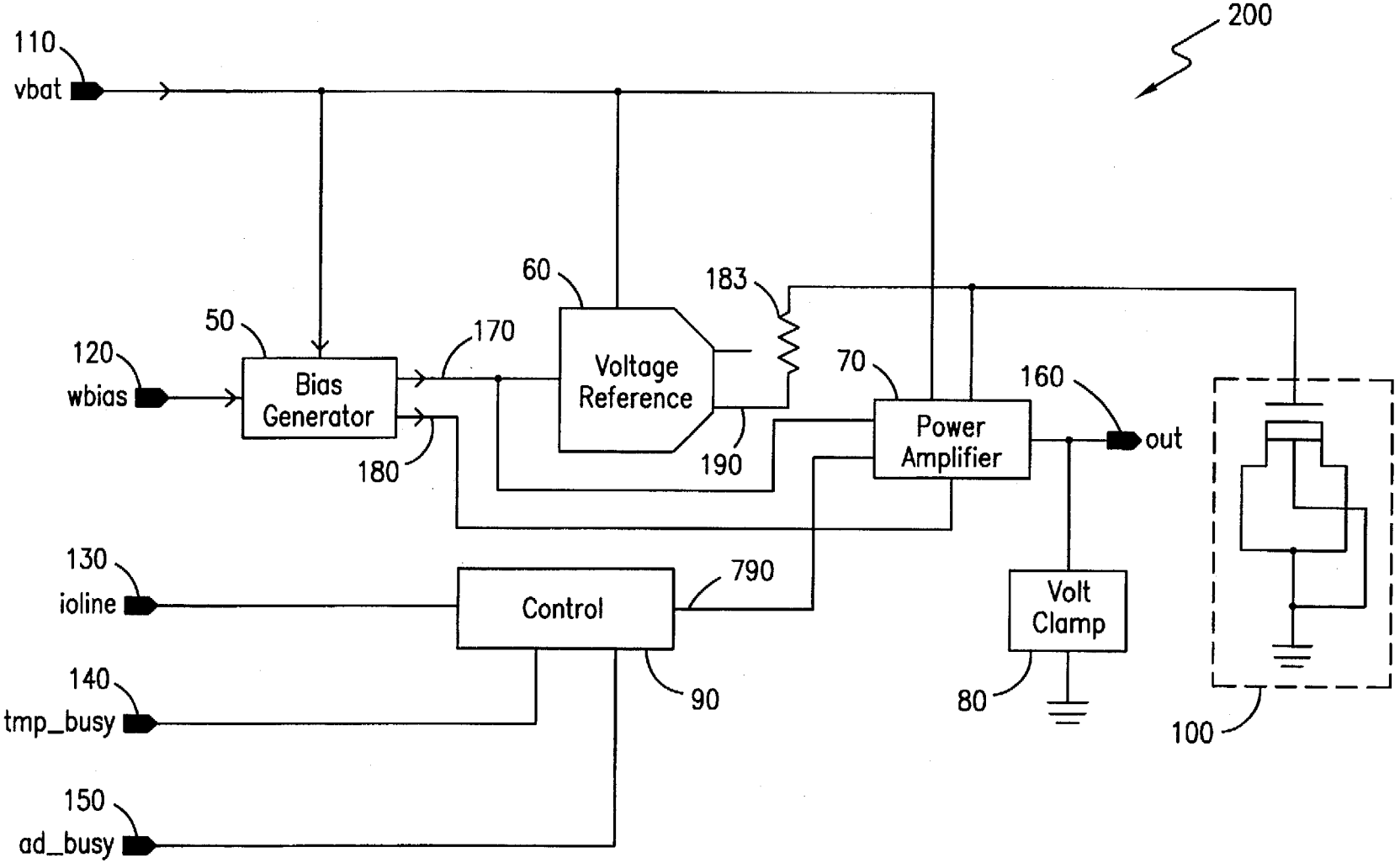
FIG. 2 is a schematic diagram of the present invention.

Referring now to FIG. 2, there is illustrated a schematic of a voltage regulator 200. Voltage regulator 200 includes a bias generator 50; voltage reference 60; power amplifier 70; a voltage clamp 80; a control circuit 90; and a capacitor 100. Voltage regulator 200 further includes inputs vbat 110 for connecting the present invention to a power source, wbias 120 for receiving a bias signal for activating/deactivating the present invention, ioline 130 for serving as a communications line, tmp_busy 140 for receiving a signal indicating the status of a temperature conversion in the thermometer system 10, and ad_busy 150 for receiving a signal indicating an analog-to-digital conversion status in the thermometer system 10. The regulator further includes an output 160 for providing the output of the present invention.

Bias generator 50 includes two inputs, one connected to wbias 120 and one connected to vbat 110. Bias generator 50 includes two outputs, biasn 170 and psrc 180 both of which provide a bias signal used by other components within the invention. The output biasn 170 connects with the voltage reference 60 and with the power amplifier 70. The other output from bias generator 50, psrc 180, connects with the power amplifier 70.

The voltage reference 60 includes an output, reference out 190, which is connected to a resistor 183. As depicted resistor 183 is connected in series to a capacitor 100. Reference out 190 is also connected to power amplifier 70.

The power amplifier 70 includes four inputs, one input connected to vbat 110, one connected to biasn 170 of bias generator 50, one connected to psrc 180 of bias generator 50, and one connected to output 790 of control circuit 90, which activates the power amplifier 70. It has one output connected to output 160, which is the output for the invention. Output 160 is limited by a voltage clamp 80.

Control circuit 90 is connected to ioline 130, tmp_busy 140, and ad_busy 150. Control circuit 90 includes an output 790, which connects to power amplifier 70.

Figure 3:
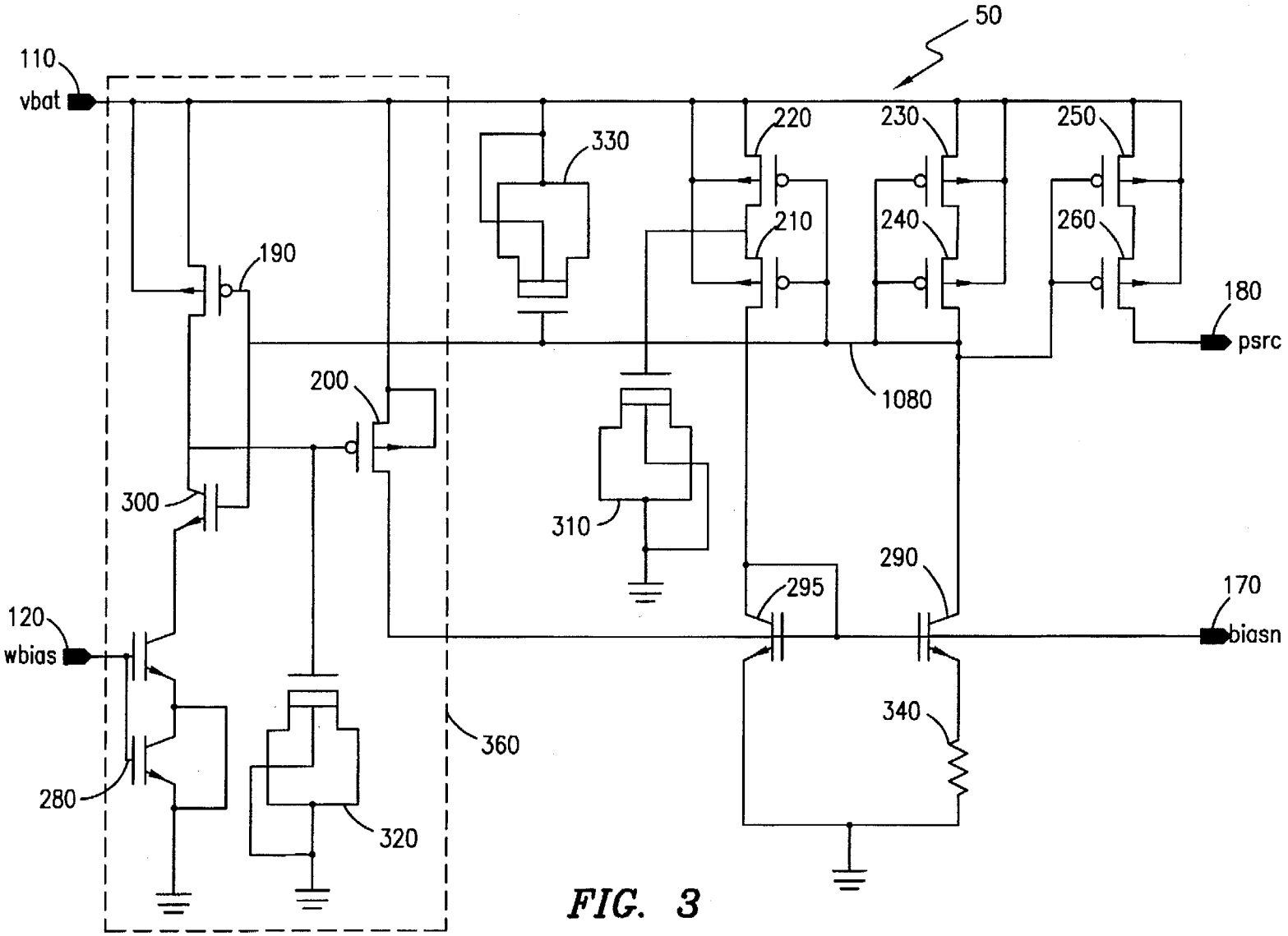
FIG. 3 is a schematic diagram of a voltage bias generator with a kick start circuit utilized in the present invention.

Referring now to FIG. 3, there is illustrated is a more detailed schematic of bias generator 50 as similarly shown in FIG. 2. Bias generator 50 includes P-channel MOSFETS 210, 220, 230, 240, 250 and 260, N-channel MOSFETS 270, 280, 290 and 295; capacitors 310 and 320; capacitor 330; and resistor 340. The bias generator 50 includes two inputs connected to inputs vbat 110 and wbias 120, and two outputs, psrc 180 and biasn 170. N-channel MOSFETS 270, 300 and 280, P-channel MOSFETS 190 and 200, and capacitor 320 form a kick start circuit 360. Kick start circuit 360 is used for activating bias generator 50.

Figure 4:
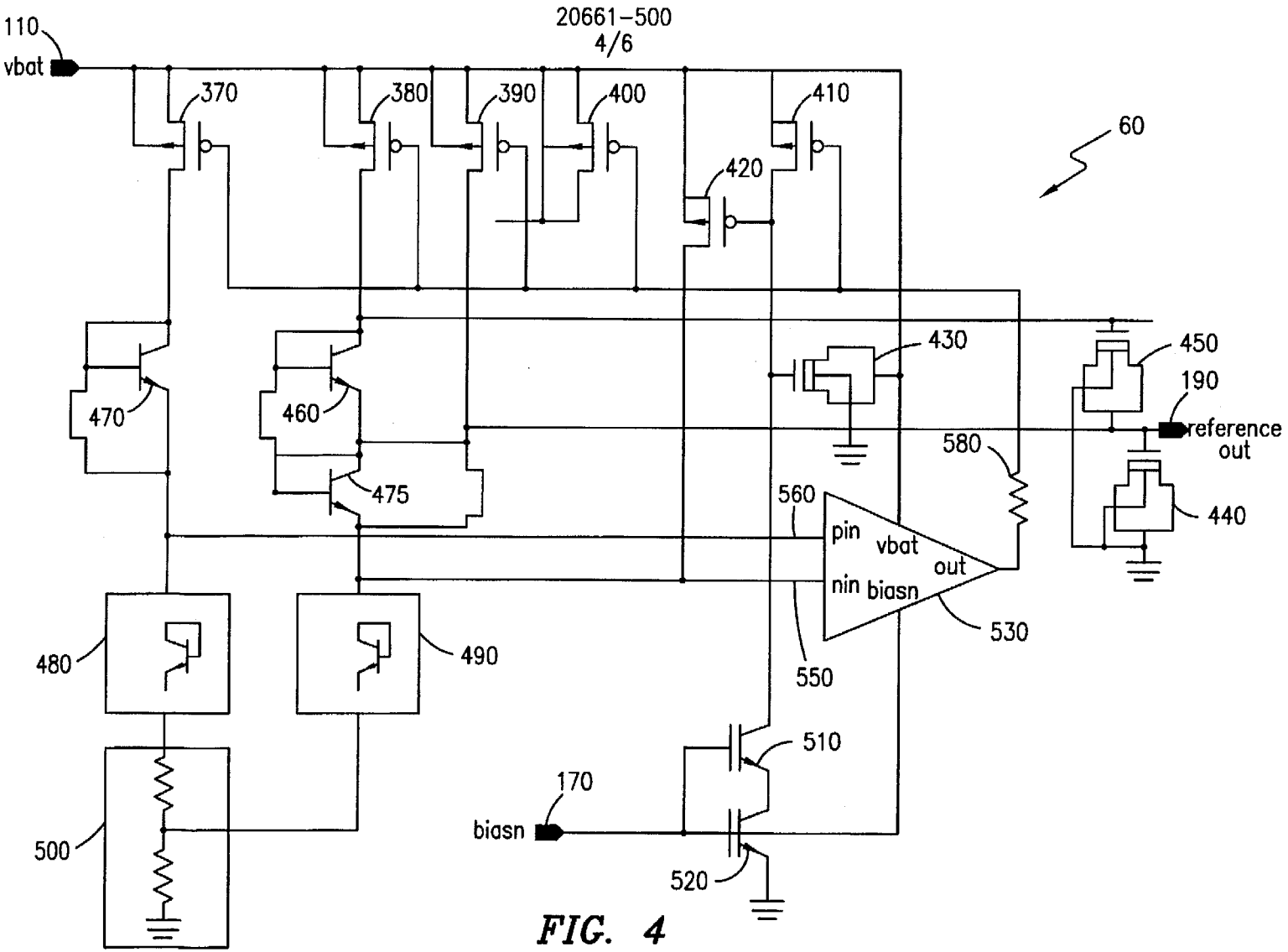
FIG. 4 is a schematic diagram of a voltage reference utilized in the present invention.

Referring now to FIG. 4, there is illustrated a detailed schematic of the voltage reference 60 as similarly shown in FIG. 2. As depicted, voltage reference 60 includes P-channel MOSFETS, 370, 380, 390, 400, 410 and 420; capacitors 430, 440, and 450; transistors 460, 470, 475; bipolar devices 480 and 490; a resistor chain 500; N-channel MOSFETS 510 and 520; and an amplifier 530. Amplifier 530 has four inputs, one connected to vbat 110, one connected to biasn 170, a negative input 550, and a positive input 560; and an output 570, which is connected to resistor 580. The voltage reference 60 further includes two inputs, one connected to vbat 110 and one connected to biasn 170 of bias generator 50, and one output which is connected to reference out 190.

Figure 5:
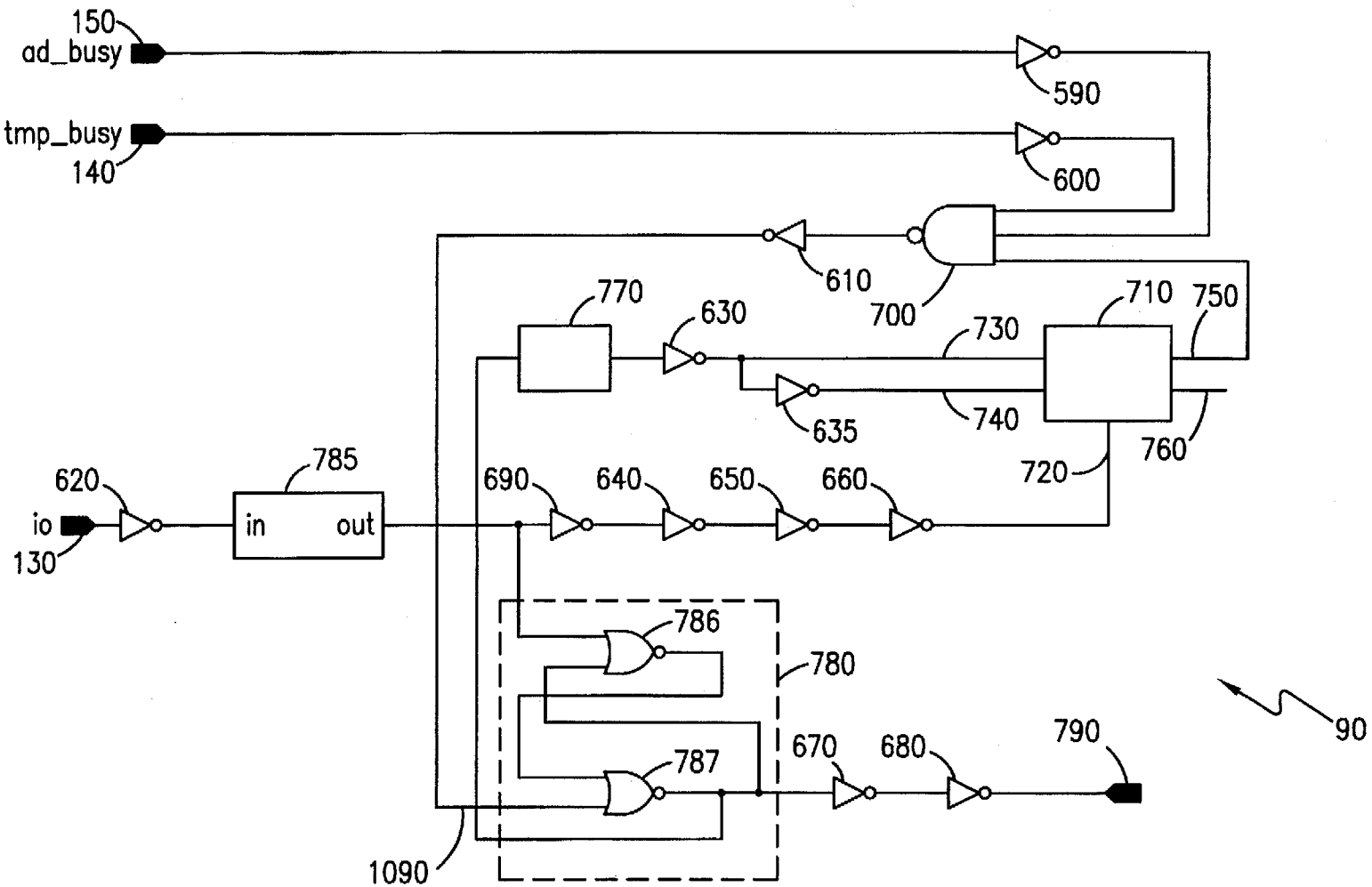
FIG. 5 is a schematic diagram of a controller utilized in the present invention.

Referring now to FIG. 5, there is illustrated a more detailed schematic of the control circuit 90 as similarly shown in FIG. 2. As depicted, the control circuit 90 includes inverters 590, 600, 610, 620, 630, 635, 640, 650, 660, 670, 680, and 690; a three-input nand-gate 700; a counter 710, the counter having inputs R 720, CLKB 730, and CLK 740; outputs Q 750 and QB 760 of which Q 750 is connected to one input of nand-gate 700; an oscillator (OSC) 770; a latch 780 comprised of two-dual input nor-gates 786 and 787; and a one shot 785.

Control circuit 90 further includes three inputs, one connected ioline 130, one converted to tmp_busy 140, and one connected to ad_busy 150; and one output 790.

Figure 6:
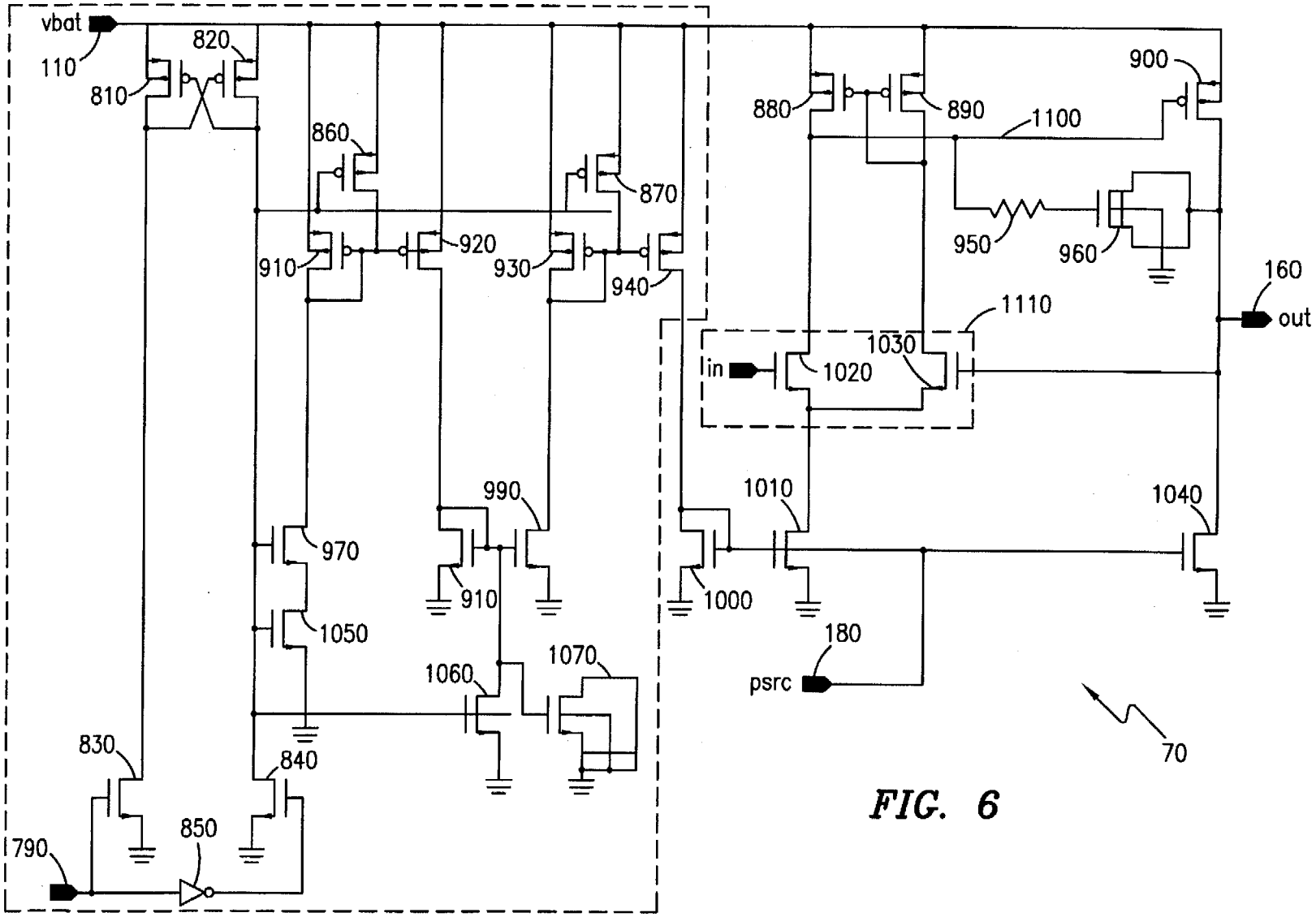
FIG. 6 is a schematic diagram of a power amplifier with a power level shifter, both of which utilized in the present invention.

Referring now to FIG. 6, there is illustrated a more detailed schematic of the power amplifier 70 as similarly shown in FIG. 2. As depicted, the power amplifier includes a power level shifter 800. Power level shifter includes P-channel MOSFETS 810, 860, 870, 910, 920, 930, 940 and 820, N-channel MOSFETS 830, 840, 970, 980, 990, 1050, and 1060, and an inverter 850; and an N-Fet capacitor 1070. The power level shifter 800 also includes two inputs, one connected to vbat 110 and one connected to output 790 of control circuit 90. The power level shifter 800 is connected to the rest of the power amplifier 70 which further includes P-channel MOSFETS 880, 890 and 900; a resistor 950; a capacitor 960; and N-channel MOSFETS 1000, 1010, 1020, 1030 and 1040.

Still referring to FIG. 6, power amplifier 70 further includes an input connected to biasn 170 of bias generator 50 and a second connected to psrc 180 of bias generator 50. The power amplifier 70 has an output 160, which is the output for the invention.

OPERATION

With reference to FIGS. 1–6, the operation of the present invention will now be described in detail. Referring in particular to FIG. 2, a positive voltage received by voltage regulator 200 at input wbias 120, which is connected to the power and reset circuit, will activate bias generator 50. In response, bias generator 50 will activate voltage reference 60, and power amplifier 70. Once activated, voltage reference 60 will output a constant voltage at 190, independent of the vbat supply voltage 110. The power amplifier 70 will then regulate its output 160 to the voltage present on its input at 190.

Referring now to FIGS. 2 and 6, control circuit 90 will respond to a falling edge being detected on a signal received at ioline 130, by outputting a signal at output 790. This forces power amplifier 70 into active mode, permitting the present invention to be able to handle voltage spikes occurring at high frequencies. Upon detecting the falling edge of a signal received at ioline 130, the control circuit 90 activates counter 710 and instructs the power amplifier 70 to remain in active mode until the counter 710 times out. At the termination of the designated count sequence, tmp_busy 140 and ad_busy 150 are checked for an indication of whether or not any corresponding activity is in progress. If a conversion is in progress, the power amplifier 70 is instructed to remain active despite the termination of the designated count sequence. After the completion of the detected conversion, the control circuit 90 will instruct the power amplifier 70 to return to standby mode, unless counter 710 has been reset by another falling edge on a signal received at ioline 130. If counter 710 has been reset, the power amplifier 70 must remain active for at least the length of the count sequence. Otherwise, if no conversion is taking place and the count sequence has terminated, the power amplifier 70 is instructed to initiate the standby mode.

Referring now to the bias generator 50 of FIG. 3, bias generator 50 generates voltage signals that can be used to mirror current signals that vary little across power supply variations. One output of bias generator 50, biasn 170, will set up an N-channel threshold voltage above ground. Biasp 1080, on the other hand, will stay about a P-channel threshold voltage below vbat 110.

To compensate for the fact that this part of the circuit has two stable states an "off" state and an "on" state, a kick start circuit 360 has been added to the bias generator 50. The input signal received at wbias 120 drives N-channel MOSFET 270 which pulls, through P-channel. MOSFET 200, on the biasn 170 line and starts the bias generator 50. Once the bias generator 50 is started, P-channel 200 will turn off, and the generator 50 will remain in an active, stable mode.

Referring now to FIGS. 2 and 4, voltage reference 60 implements a band gap reference. The band gap reference is implemented by bipolar devices 480 and 490 and resistor chain 500. The reference signal produced at reference out 190 is generated using feedback by amplifying the voltage difference between bipolars 480 and 490 at nodes 560 and 550.

Referring now to FIGS. 2 and 5, a changing input received at ioline 130 is detected by the One Shot 785. The changing input causes a pulse to be put on the output of the One Shot 785. That, in turn, resets the latch 780. By tripping that latch 780, the pulse enables RC based oscillator 770. The output from oscillator 770 creates a clock function that is fed into a counter 710. Each time a changing input is detected by the One Shot 785, the counter 710 will be reset. When the counter 710 has counted to its appropriate set number and there is no conversion in progress as indicated by tmp_busy 140 and ad_busy 150, a signal called DONE 1090 is activated. When the signal DONE 1090 is activated, the signal at output 790 of control circuit 90 changes and the power amplifier 70 is switched into standby mode.

Referring now to FIGS. 2 and 6, the transistors 830, 840, 810, 820, 860, 870, 910, 920, 930, 940, 970, 980, 990, 1050, 1060 and the inverter 850 of power amplifier 70 form a power level shifter 800 connected to the rest of power amplifier 70. The power level shifter 800 takes the power amplifier 70 from the standby mode to an active mode which has increased current and power consumption. When the power level shifter 800 is activated, the signal received at biasn 170 is mirrored and amplified. The signal is mirrored and amplified such that in N-channel MOSFET 1000, which is ½ the bias current flowing through differential pair 1110 formed by transistors 1020 and 1030, the current is 32 times the bias level flowing at N-channel MOSFET 970. The current through transistor 1000 is then added to the current from psrc 180. When in standby mode, the only current through MOSFET 1000 is from psrc 180, which is a significantly lower current.

N-channel MOSFETS 1020 and 1030 form a differential pair 1110 that controls the output 160 by providing an internal signal, GATE 1100. GATE 1100 drives a large P-channel MOSFET 900, which acts as a current source. P-channel MOSFET 900 is sized so that it can supply high currents. The increase in current through differential pair 1110 of 1020 and 1030 increases the frequency response of signal GATE 1100, ensuring that the circuit will not collapse when high frequency current spikes appear on output 160. The resistor 950 and the capacitor 960 provide compensation to prevent the output from oscillating.

CONCLUSION

Although a preferred embodiment of the method and apparatus of the present invention has been illustrated in the accompanying Drawings and described in the foregoing Detailed Description, it will be understood that the invention is not limited to the embodiment disclosed, but is capable of numerous rearrangements, modifications and substitutions without departing from the spirit of the invention as set forth and defined by the following claims.

What is claimed is:

1. A regulator for a thermometer system for regulating power supplied to the thermometer system from a power supply, said regulator comprising:

a reference voltage generator connected to the power supply;

a power amplifier, connected to the power supply and said reference voltage generator, said power amplifier for amplifying and outputting a power signal at a selected level, including a current at a selected amperage and a potential at a selected voltage;

an output for outputting the power signal;

a control system connected to said power amplifier for activating and deactivating said power amplifier; and a voltage clamp connected to said power amplifier, said voltage clamp for restricting said output to a selected voltage.

2. The regulator as recited in claim 1, wherein said voltage claim comprises a diode string.

3. The regulator as recited in claim 1, further comprising a surge protector for restricting high voltages between said reference voltage generator and said power amplifier, said surge protector being connected between said reference voltage generator and said power amplifier.

4. The regulator as recited in claim 3 wherein said surge protector comprises a capacitor.

5. The regulator as recited in claim 1, wherein said power amplifier includes a power level shifter connected to the power supply, said power level shifter for placing said power amplifier in a mode capable of smoothing voltage spikes appearing at high frequencies.

6. The regulator as recited in claim 1, wherein said power amplifier includes a plurality of N-Type and P-Type transistors.

7. The regulator as recited in claim 1, wherein said reference voltage generator includes:

a bias generator for generating a bias voltage used in said power amplifier; and a band gap reference.

8. The regulator as recited in claim 1, wherein said control system includes: an input for receiving a signal to activate and deactivate said power amplifier.

9. The regulator as recited in claim 7, wherein said bias generator includes a kick start circuit for activating said bias generator.

10. An electronic circuit for regulating a voltage signal provided by a power source, said electronic circuit comprising:

a first mode for consuming low amounts of static power;

a second mode for operating at a power level necessary for the electronic circuit to regulate the power signal and smooth voltage spikes;

a generator for generating reference signals, including voltage and current;

an amplifier for amplifying current from the reference power signal generated by said generator; said amplifier having an output line carrying both current and voltage a shifter for shifting said electronic circuit between said first mode and said second mode, said shifter connected to said amplifier; and a regulator for regulating the output of said amplifier.

11. The electronic circuit as recited in claim 10 further comprising:

a control unit for determining whether said current needs to be amplified; and means for changing said electronic circuit between said first mode and said second mode.

12. The electronic circuit as recited in claim 11, wherein said control unit includes:

an input/output line;

a status line;

a timer connected to said input/output line; and a comparator connected to said timer and said status line, said comparator for determining whether current needs to be amplified.

13. The electronic circuit as recited in claim 12, wherein said status line includes a temperature conversion indicator.

14. The electronic circuit as recited in claim 12, wherein said status line includes an analog-to-digital conversion indicator.

15. The electronic circuit as recited in claim 10, further comprising a means for initiating operation of said first mode.

16. The electronic circuit as recited in claim 10, wherein said generator includes a kick start circuit for activating said generator.

17. The electronic circuit as recited in claim 10, wherein said regulator includes a power level shifter for shifting said regulator between said first mode and said second mode.

18. An electronic circuit for regulating a power signal provided to a thermometer system, said electronic circuit comprising:

a kickstart circuit;

a reference voltage generator connected to said kickstart circuit; said reference voltage generator partially activated by said kickstart circuit;

a power level shifter connected to said reference voltage generator;

a current amplifier connected to said power level shifter, said current amplifier partially activated by said power level shifter;

a controller connected to said current amplifier, for activating and deactivating said current amplifier; and a voltage limiter connected to said current amplifier, for limiting output of said current amplifier to a select voltage.

19. A regulator for regulating power supplied to a system from a power supply, said regulator comprising:

a reference voltage generator connected to the power supply;

a power amplifier connected to each of the power supply and said reference voltage generator, said power amplifier for amplifying and outputting a power signal at a selected level;

an output for outputting the power signal;

a control system connected to said power amplifier, said control system for activating and deactivating said power amplifier; and a surge protector coupled between said reference voltage generator and said power amplifier, said surge protector for restricting high voltages between said reference voltage generator and said power amplifier.

20. A regulator for regulating power supplied to a system from a power supply, said regulator comprising:

a reference voltage generator connected to the power supply;

a power amplifier connected to each of the power supply and said reference voltage generator, said power amplifier for amplifying and outputting a power signal at a selected level;

said power amplifier including a power lever shifter connected to the power supply, said power lever shifter for placing said power amplifier in a mode capable of smoothing voltage spikes appearing at high frequencies;

an output for outputting the power signal; and a control system connected to said power amplifier, said control system for activating and deactivating said power amplifier.

21. A regulator for regulating power supplied to a system from a power supply, said regulator comprising:

a reference voltage generator connected to the power supply, said reference voltage generator including a bias generator for generating a bias voltage, and said reference voltage generator further including a band gap reference;

a power amplifier connected to each of the power supply and said reference voltage generator, said power amplifier for amplifying and outputting a power signal at a selected level;

an output for outputting the power signal; and a control system connected to said power amplifier, said control system for activating and deactivating said power amplifier.

* * * * *

UNITED STATES PATENT AND TRADEMARK OFFICE

CERTIFICATE OF CORRECTION

PATENT NO. : 5,754,037

DATED : May 19, 1998

INVENTOR(S) : Ezell et al.

It is certified that error appears in the above-identified patent and that said Letters Patent is hereby corrected as shown below:

| | |
|---|---|
| Column 1, line 19 | Replace "688444"<br>With --688,444-- |
| Column 3, line 37 | After "illustrated"<br>Delete --is-- |
| Column 5, line 8 | After "P-channel"<br>Delete --.-- |
| Column 6, line 19 | Replace "claim"<br>With --clamp-- |

Signed and Sealed this

Nineteenth Day of January, 1999

*Attest:*

*Attesting Officer*

*Acting Commissioner of Patents and Trademarks*